US011339746B2

(12) United States Patent
Cham et al.

(10) Patent No.: US 11,339,746 B2
(45) Date of Patent: May 24, 2022

(54) ELECTROMAGNETIC DEVICE COMPRISING A VAPOUR OUTLET CONDUIT ARRANGED IN AN INTERMEDIATE CASING

(71) Applicant: Valeo Systemes de Controle Moteur, Cergy Saint Christophe (FR)

(72) Inventors: Renaud Cham, Cergy-Pontoise (FR); Luis Amaya, Cergy-Pontoise (FR); Rajendran Vellayagounder, Cergy-Pontoise (FR); Vincent Andrieu, Cergy-Pontoise (FR)

(73) Assignee: Valeo Systemes de Controle Moteur, Cergy Saint Christophe (FR)

( * ) Notice: Subject to any disclaimer, the term of this patent is extended or adjusted under 35 U.S.C. 154(b) by 0 days.

(21) Appl. No.: 17/253,759

(22) PCT Filed: Jun. 21, 2019

(86) PCT No.: PCT/EP2019/066540
§ 371 (c)(1),
(2) Date: Dec. 18, 2020

(87) PCT Pub. No.: WO2019/243611
PCT Pub. Date: Dec. 26, 2019

(65) Prior Publication Data

US 2021/0270214 A1 Sep. 2, 2021

(30) Foreign Application Priority Data

Jun. 22, 2018 (FR) ..... 1855587

(51) Int. Cl.
*F02M 25/08* (2006.01)
*F02M 37/48* (2019.01)

(52) U.S. Cl.
CPC ..... *F02M 25/0836* (2013.01); *F02M 25/089* (2013.01); *F02M 37/48* (2019.01); *F02M 2025/0845* (2013.01)

(58) Field of Classification Search
CPC .. F02M 25/0836; F02M 37/48; F02M 25/089; F02M 2025/0845; F02M 25/08
See application file for complete search history.

(56) References Cited

U.S. PATENT DOCUMENTS

2008/0000456 A1 1/2008 Modien
2012/0318243 A1 12/2012 Williams
2014/0311602 A1* 10/2014 Jefford ..... F16K 31/02 137/899

FOREIGN PATENT DOCUMENTS

DE 102004006874 A1 9/2005

OTHER PUBLICATIONS

International Search Report issued in corresponding PCT Application No. PCT/EP2019/066540, dated Aug. 7, 2019 (5 Pages with English Translation).

(Continued)

*Primary Examiner* — Jacob M Amick
(74) *Attorney, Agent, or Firm* — Osha Bergman Watanabe & Burton LLP

(57) ABSTRACT

The present invention relates to an electromagnetic device (10) comprising: —an electromagnetic system (60), —a fuel vapour outlet conduit (30) extending the electromagnetic system (60), —a first housing (61), in which the electromagnetic system (60) is arranged. The invention is characterized in that the fuel vapour outlet conduit (30) is arranged in an intermediate housing (71).

8 Claims, 2 Drawing Sheets

(56) References Cited

OTHER PUBLICATIONS

Figure 1:
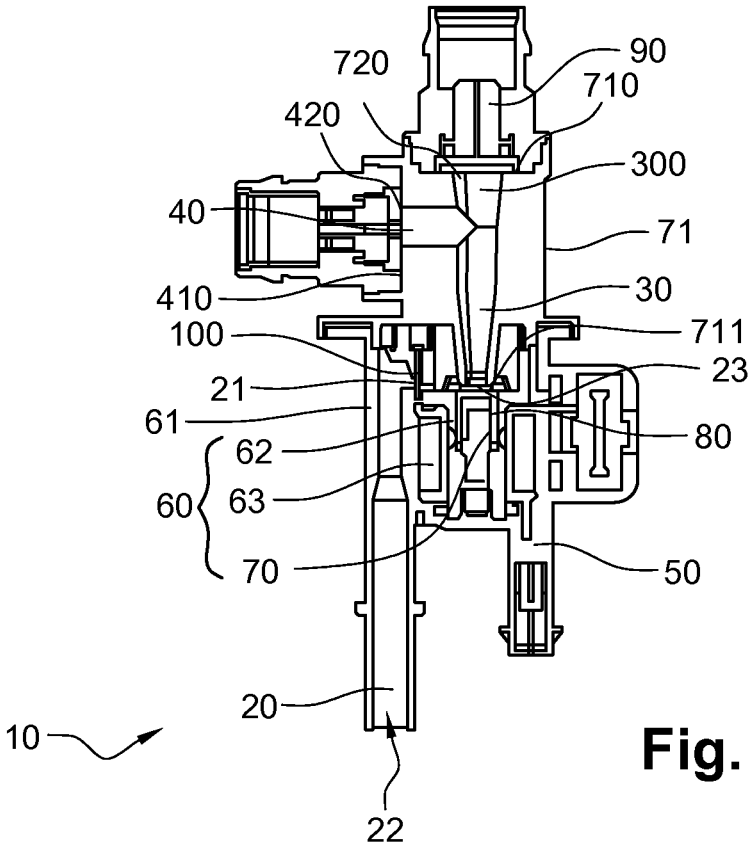

Written Opinion issued in Corresponding PCT Application No. PCT/EP2019/066540, dated Aug. 7, 2019 (5 Pages).

* cited by examiner

ELECTROMAGNETIC DEVICE COMPRISING A VAPOUR OUTLET CONDUIT ARRANGED IN AN INTERMEDIATE CASING

The present invention relates to electromagnetic devices having a coil and an element that is movable under the effect of the magnetic field of the coil, and more particularly to an electromagnetic device incorporating connection means.

Vehicles having an internal combustion engine are conventionally provided with an active-carbon filter known as a canister, which absorbs and retains the fuel vapors coming from the tank. The canister is connected to the intake of the engine via a purge solenoid valve, which is closed when the engine is stopped and opens so as to allow the canister to be purged when the engine is running. Excess vapors in the tank are thus discharged toward the engine, where they are burnt. The activation of the canister purge valve depends on the manufacturer's purge cycles.

Nowadays, standards relating to the levels of fuel vapor emissions are increasingly strict. Therefore, it is necessary to adapt the current devices to these standards. One of the problems of these adaptations arises from the fact that it is necessary to add sensors, and valves for regulating and limiting emissions. However, adding all of these components to the vapor transport circuit amplifies the problem of emission by increasing leaks at the connections, which are often of the pneumatic type.

It is thus necessary to provide a device for limiting the emissions.

To this end, the present invention proposes an electromagnetic device having:

an electromagnetic system, a fuel vapor outlet duct extending the electromagnetic system, a first casing in which the electromagnetic system is disposed, the fuel vapor outlet duct being disposed in an intermediate casing.

According to one embodiment of the invention, the intermediate casing is disposed in the continuation of the first casing.

According to one embodiment of the invention, the fuel vapor outlet duct continues inside the intermediate casing and leads out of the casing through a different face than the one at which it passes into the intermediate casing.

According to one embodiment of the invention, the fuel vapor outlet duct splits into two ducts.

According to one embodiment of the invention, the device has at least one additional element connected to one end of the duct.

According to one embodiment of the invention, the device has two safety valves.

According to one embodiment of the invention, the device has a filter disposed on the path of the fuel vapors upstream of the electromagnetic system.

According to one embodiment of the invention, the two ducts form an angle of 90° C. with one another or an angle less than 90° C.

The invention also relates to the use of the device according to the invention in a motor vehicle.

Figure 2:
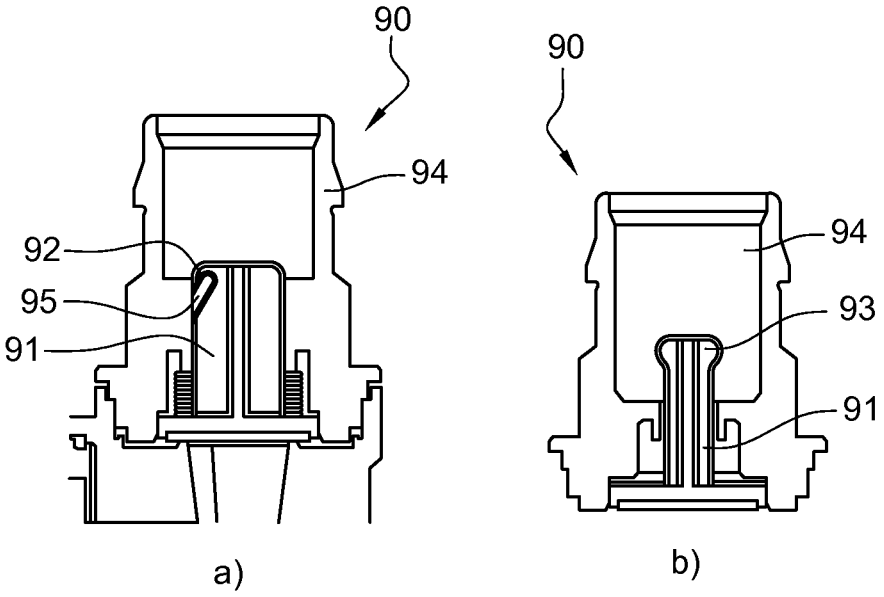
Figure 3:
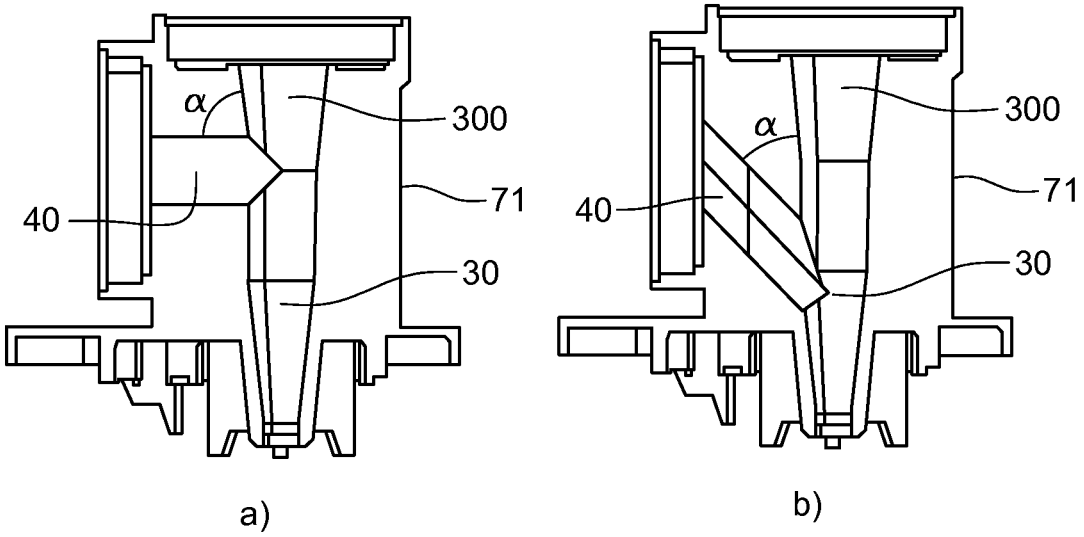
Figure 4:
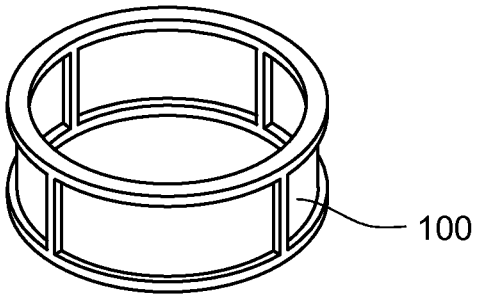

Further aims, features and advantages of the invention will be understood better and will become more clearly apparent from reading the description given below with reference to the appended figures, which are given by way of example and in which:

FIG. 1 is a schematic depiction of a longitudinal section through a device according to the invention, FIG. 2 is a schematic depiction of a longitudinal section through two embodiments of a device according to the invention, 2*a*) diaphragm cooperating with a protrusion, 2*b*) diaphragm with a widened head, FIG. 3 is a schematic depiction of a longitudinal section through two embodiments of a device according to the invention, 3*a*) ducts at an angle of 90° C., 3*b*) ducts at an angle <90° C., FIG. 4 is a view of the filter of the device according to the invention.

The present invention relates to an electromechanical device 10, and more particularly to a canister purge solenoid valve 10 having at least one fuel vapor outlet duct, having a connector, incorporated in a casing of the solenoid valve.

The objective of this incorporation is to allow the connection to at least one other element such as a valve, or a sensor, or some other element, without an additional connection, and thus without additional emission.

The device 10 according to the invention, illustrated in FIG. 1, has a fuel vapor inlet duct 20 connected to a circulation duct for the fuel vapors arriving from a fuel tank, and a fuel vapor outlet duct 30.

The device 10 has at least one connector 50 for the electrical connection thereof.

The materials of the device 10 are chosen to withstand hydrocarbon vapors, in particular gasoline vapors.

A first casing 61 of the device 10 houses within it an electromagnetic system 60. The latter has a tubular fixed core 62 of axis X made of a soft ferromagnetic material such as iron or a ferromagnetic steel, for example.

The electromagnetic system 60 has a coil 63 that extends around the fixed core 10 in order to generate a magnetic field therein when it is supplied with electric power. The coil 63 is made for example of insulated, in particular enameled, copper wire.

The system also has an element that is movable along the axis X under the effect of the magnetic field generated by the coil 63, this movable element being in the form of a plunger core 70, made of a ferromagnetic material, that is movable axially along the axis X inside the fixed core 62.

The plunger core 70 is inside the fixed core in the example in question, and the flow, which is preferably gaseous (fuel vapors in the present case), takes place in contact therewith when it is open.

According to one embodiment of the invention, the plunger core 70 is made of a soft magnetic material, which loses its magnetization when the magnetic field of the core stops, just like the fixed core 62.

The plunger core 70 comes to bear against a valve seat provided with an orifice 23 through which the fuel vapors circulate when the device is open.

A return spring 80 returns the plunger core 70 into its rest position, closing the outlet duct, when the solenoid valve is not supplied with electric power.

The inlet duct 20 has an inlet opening 21 through which the fuel vapors arrive, and an outlet opening 21 through which the fuel vapors are discharged, upstream of the orifice 23 in the valve seat.

The electromagnetic system 60 is continued by the fuel vapor outlet duct 30. This duct has, at its base, a nozzle. This nozzle serves to optimize the flow and the flow rate of the discharged fuel vapors. It is thus the nozzle that continues in the form of the fuel vapor outlet duct 30.

In the context of the invention, the fuel vapor outlet duct 30 is disposed in an intermediate casing 71.

This intermediate casing 71 is disposed in the continuation of the first casing 61.

According to one embodiment of the invention, the intermediate casing 71 is fixed to the first casing 61. The fixing is realized by welding, adhesive bonding or any means compatible with the use of the device.

According to one embodiment of the invention, the fuel vapor outlet duct 30 continues inside the intermediate casing 71 and leads out of the casing through a different face 710 than the one 711 at which it passes into the intermediate casing 71. According to one embodiment of the invention, the duct 30 leads out of the casing through a face 710 opposite the one 711 at which it passes into the intermediate casing 71. According to another embodiment of the invention, the duct 30 leads out of the casing through a face adjacent to the one 711 at which it passes into the intermediate casing 71. The term "pass in" describes here the end of the duct 30 that is in contact with the electromagnetic system 60 of the duct 30, and which is therefore situated in the intermediate casing 71.

According to one variant of the invention, the fuel vapor outlet duct 30 has a branch 40. More specifically, the fuel vapor outlet duct 30 splits into two ducts 40, 300. The second duct 40 leads out at one of the faces adjacent to one of the two inlet 711 and outlet 710 faces for the fuel vapors.

The faces 710, through which the fuel vapor outlet duct 30 leads out thus each have an opening 720, 420.

According to another embodiment, in the case of the first variant, when the duct 30 does not have a branch or second duct, the intermediate casing 71 has only one opening.

These openings 720, 420 thus each allow the connection of an additional element 90.

There is thus no communication and therefore no leakage between the two casings 61, 71. The vapors arriving from the fuel vapor outlet duct 30 are discharged directly to the outside of the intermediate casing 71, without passing into the latter.

The intermediate casing 71 thus allows the support of the ducts 30, 40 and the associated connections 90.

According to one embodiment of the invention, this additional element 90 is a safety valve illustrated in FIGS. 1 to 3.

According to one embodiment, the device 10 has two safety valves illustrated in FIGS. 1 and 2*a*, 2*b*.

According to one embodiment of the invention, this additional element 90 is a connector, visible in FIGS. 2*a* and 2*b*, for any other element that is compatible with the device.

According to one embodiment of the invention, the two ducts 40 and 300 are disposed perpendicularly to one another. More specifically, they form an angle $\alpha$ of 90° C. or other than 90° C. with one another.

According to another embodiment of the invention, the two ducts are disposed so as to form an angle $\alpha'$ of less than 90° C. Such a configuration allows a better flow rate.

The angle $\alpha$, $\alpha'$ is the angle formed by the two ducts 300, 40 originating from the fuel vapor outlet duct 30.

According to one embodiment of the invention, when the additional element 90 is a safety valve, the latter has a diaphragm 91 visible in FIGS. 2*a* and 2*b*. The diaphragm is configured so as to be held in place in the body 94 of the valve during the assembly of the safety valve 90. According to a first variant of the invention in FIG. 2*a*, the diaphragm 91 has a recess 92 that cooperates with a protrusion 95 formed in the body of the valve. The diaphragm is thus immobilized during assembly. According to a second variant of the invention in FIG. 2*b*, the end 93 of the diaphragm has a larger diameter than the diameter of the piston 91. The diaphragm thus can no longer move, apart from the movement necessary for it to function, when it is housed in the body 94 of the safety valve 90.

The fuel vapors circulating in the device 10 are loaded with particles. In order to protect the plunger core and to avoid the obstruction of the fuel vapor outlet duct 30, the device 10 has a circular filter 100. The filter 100 is disposed on the path of the fuel vapors upstream of the plunger core 70. More specifically, the filter 100 is disposed at the opening 21 in the inlet duct 20 and upstream of the plunger core and the orifice 23 in the valve seat.

Such a circular filter makes it possible to trap the particles directly at the outlet of the fuel vapor inlet duct 20 and allows the fuel vapors to circulate without particles all around the electromagnetic system 60.

In the context of the invention, the filter is an anti-particle filter for filtering particles with a size greater than or equal to 50 μm.

The scope of the present invention is not limited to the details given above and allows embodiments in numerous other specific forms without moving away from the field of application of the invention. Consequently, the present embodiments should be considered to be by way of illustration, and can be modified without otherwise departing from the scope defined by the claims supported by the description.

The invention claimed is:

1. An electromagnetic device, comprising:

an electromagnetic system having a coil that extends around a fixed core to generate a magnetic field therein when it is supplied with electric power;

a fuel vapor outlet duct extending the electromagnetic system;

a first casing in which the electromagnetic system is disposed;

a filter disposed on a path of a fuel vapors upstream of the electromagnetic system, wherein the fuel vapor outlet duct is disposed in an intermediate casing, wherein the intermediate casing is disposed in continuation of the first casing such that the intermediate casing is fixed to the first casing; and wherein the filter is disposed at an opening in an inlet duct.

2. The electromagnetic device as claimed in claim 1, wherein the fuel vapor outlet duct continues inside the intermediate casing and leads out of the intermediate casing through a different face than the one at which it passes into the intermediate casing.

3. The electromagnetic device as claimed in claim 1, wherein the fuel vapor outlet duct splits into two ducts.

4. The electromagnetic device as claimed in claim 3, having at least one additional element connected to one end of the duct.

5. The electromagnetic device as claimed in claim 1, further comprising two safety valves.

6. The electromagnetic device as claimed in claim 4 wherein the two ducts and form an angle of 90° C. with one another or an angle less than 90° C.

7. The electromagnetic device as claimed in claim 1, wherein the electromagnetic device is employed in a motor vehicle.

8. The electromagnetic device as claimed in claim 1, wherein the filter filters particles with a size greater than or equal to 50 μm.

* * * * *